US006317899B1

(12) United States Patent
Brewer

(10) Patent No.: US 6,317,899 B1
(45) Date of Patent: Nov. 20, 2001

(54) DUAL FLUSH TOILET

(75) Inventor: Kirk S. Brewer, San Pedro, CA (US)

(73) Assignee: Niagara Conservation Corporation, Cedar Knolls, NJ (US)

( * ) Notice: Subject to any disclaimer, the term of this patent is extended or adjusted under 35 U.S.C. 154(b) by 0 days.

(21) Appl. No.: 09/640,640

(22) Filed: Aug. 17, 2000

(51) Int. Cl.[7] ..... E03D 1/20
(52) U.S. Cl. ..... 4/365; 4/325
(58) Field of Search ..... 4/365, 324, 325, 4/326

(56) References Cited

U.S. PATENT DOCUMENTS

| | | | |
|---|---|---|---|
| 3,909,582 | 9/1975 | Bowen | 219/121 LM |
| 4,175,295 | 11/1979 | Cameron | 4/327 |
| 4,197,598 | 4/1980 | Lemmon | 4/326 |
| 4,304,014 | 12/1981 | Thompson | 4/325 |
| 4,371,993 | 2/1983 | Patrick | 4/448 |
| 4,419,772 | 12/1983 | Smith | 4/364 |
| 4,549,063 | 10/1985 | Ang et al. | 219/121 LJ |
| 4,561,131 | 12/1985 | David | 4/326 |
| 4,646,369 | 3/1987 | Brown et al. | 4/365 |
| 5,067,180 | 11/1991 | Figeroid | 4/326 |
| 5,111,537 | 5/1992 | Zaruba | 4/324 |
| 5,117,513 | 6/1992 | Burrowes | 4/324 |
| 5,129,110 | 7/1992 | Richter | 4/324 |
| 5,191,662 | 3/1993 | Sharrow | 4/325 |
| 5,261,129 | 11/1993 | Roy | 4/326 |
| 5,319,809 | 6/1994 | Testa | 4/325 |
| 5,333,332 | 8/1994 | Kam | 4/326 |
| 5,341,520 | 8/1994 | Lazar | 4/325 |
| 5,495,624 | 3/1996 | Lissok et al. | 4/325 |
| 5,548,850 | 8/1996 | Geeham | 4/326 |
| 5,630,308 | 5/1997 | Guckenberger | 53/412 |
| 5,642,533 | 7/1997 | Young | 4/325 |
| 5,666,674 * | 9/1997 | Hennessy | 4/365 |
| 5,873,136 | 2/1999 | Geeham | 4/434 |
| 5,887,292 | 3/1999 | Goren | 4/363 |
| 5,887,293 * | 3/1999 | Hennessy | 4/365 |

FOREIGN PATENT DOCUMENTS

| | | | |
|---|---|---|---|
| 3436753 * | 4/1986 | (DE) | 4/324 |

* cited by examiner

*Primary Examiner*—Charles E. Phillips
(74) *Attorney, Agent, or Firm*—Dorsey & Whitney LLP

(57) ABSTRACT

A dual flush water conservation toilet includes separate fill tanks in a toilet tank which pivot to deposit water into a plenum chamber in the toilet tank. The fill tanks are selectively pivoted to deposit different quantities of water for flushing.

10 Claims, 7 Drawing Sheets

DUAL FLUSH TOILET

BACKGROUND OF THE INVENTION

The present invention relates to a water conservation toilet and more particularly to a toilet designed to allow a dual flush alternative. Accordingly the present invention is directed to a toilet which can deliver a first volume of water which is sufficient to empty the contents of the toilet bowl when an individual has urinated in the bowl and a second larger quantity of water sufficient to empty the contents of the bowl when a bowel movement has occurred.

In recent years there has been a greater emphasis on conserving natural resources such as water and fossil fuels. Particularly in the water conservation area, especially in commercial buildings such as offices, hotels and apartments, water saving faucets and shower heads have become more and more prevalent in usage as they considerably save the volume of water used through normal activities such as washing and showering. In addition, attempts have been made to provide similar water conservation principals in the use of toilets so that the volume of water used per flush is decreased. Large volumes of water are consumed in a typical toilet when it is flushed. The average flush of a toilet consumes approximately three to five gallons of water and this is far in excess of the amount required for an effective evacuation of the toilet bowl, even when evacuating a bowel movement.

It has been recognized in the past that one way to conserve the volume of water used in flushing a toilet is to provide a dual flush alternative where a first limited volume of water is discharged when the toilet has been used only for urination and a second larger volume is discharged when the toilet has been used for a bowel movement. One such prior art device is shown in U.S. Pat. No. 5,067,180 to Figeroid. In this patent the toilet tank is segregated into two compartments each having a flap release valve controlled through a single flush actuating handle. The mechanism is complex and requires the use of two flappers and careful control by the user to initiate either a limited water flush capacity or maximum water flush capacity.

A somewhat similar device is shown in U.S. Pat. No. 4,419,772 to Smith which also shows use of a primary and secondary tank area within the water containing tank of a toilet and which is activated by the user according to the needs by controlling the single lever used to flush the tank.

Other attempts to address the problem of conserving water in toilet flushing are shown in U.S. Pat. Nos. 5,129,110 to Richter, 5,191,662 to Sharrow, 4,304,014 to Thompson, 5,117,513 to Burrowes, 4,646,369 to Brown et al, 4,561,131 to David, 5,495,624 to Lisook et al, 5,319,809 to Testa, 5,548,850 to Geeham, 5,642,533 to Young, 5,873,136 to Geeham and 5,887,292 to Goren. All of these prior art attempts to provide for a dual capacity flush toilet utilize somewhat complex mechanisms and/or the use of two flap or ball valves to control water egress from the toilet tank to the toilet bowl. These mechanisms, because of their complexity, may also be prone to failure in time and the use of ball or flap valves to control water egress are also prone to failure after a period of time.

Accordingly it is an object of the present invention to provide a dual flush capacity water conservation toilet of simple construction with simple mechanism so as to provide a long and useful life without premature failure or need for repair.

It is yet another object of the present invention to provide a dual flush capacity toilet of simple construction which can be economically manufactured and which is simple to use.

These and other objects and advantages of the present invention will become more readily apparent after consideration of the accompanying specification and drawings.

DESCRIPTION OF THE PREFERRED EMBODIMENTS

Figure 1:
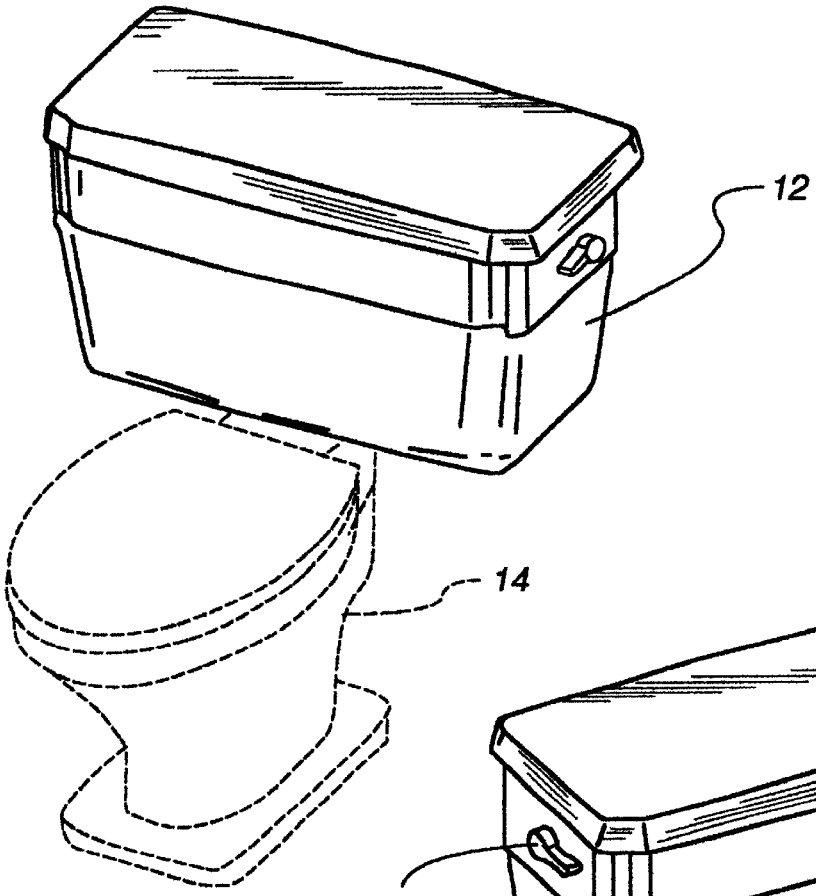
FIG. 1 is a perspective view of a typical toilet.
Figure 2:
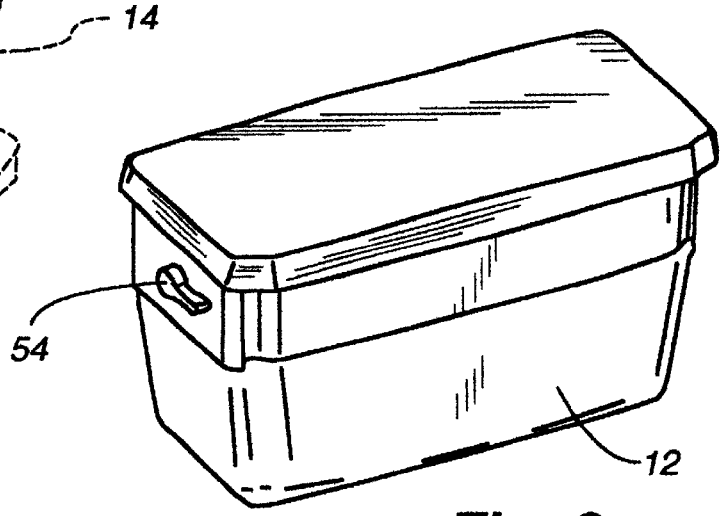
FIG. 2 is a perspective view of a toilet tank for holding water for flushing.
Figure 3:
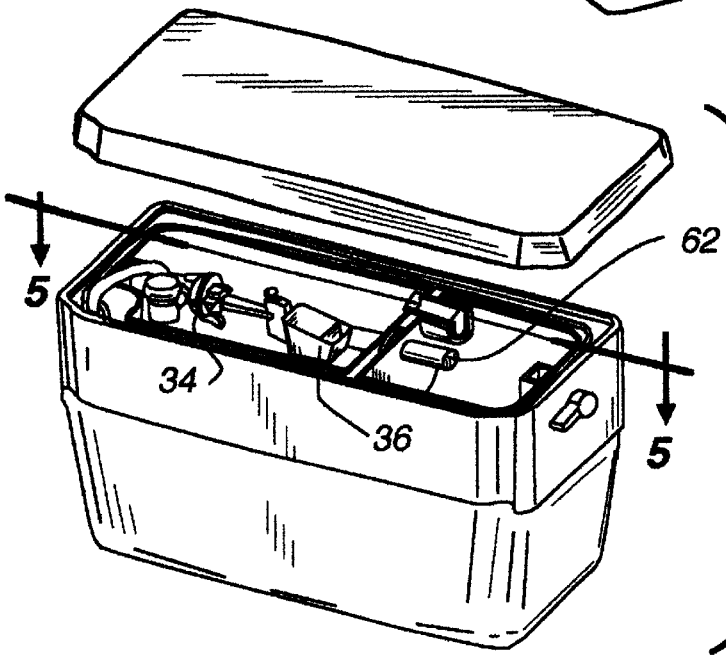
FIG. 3 is an exploded isometric showing the mechanism of the present invention.
Figure 4:
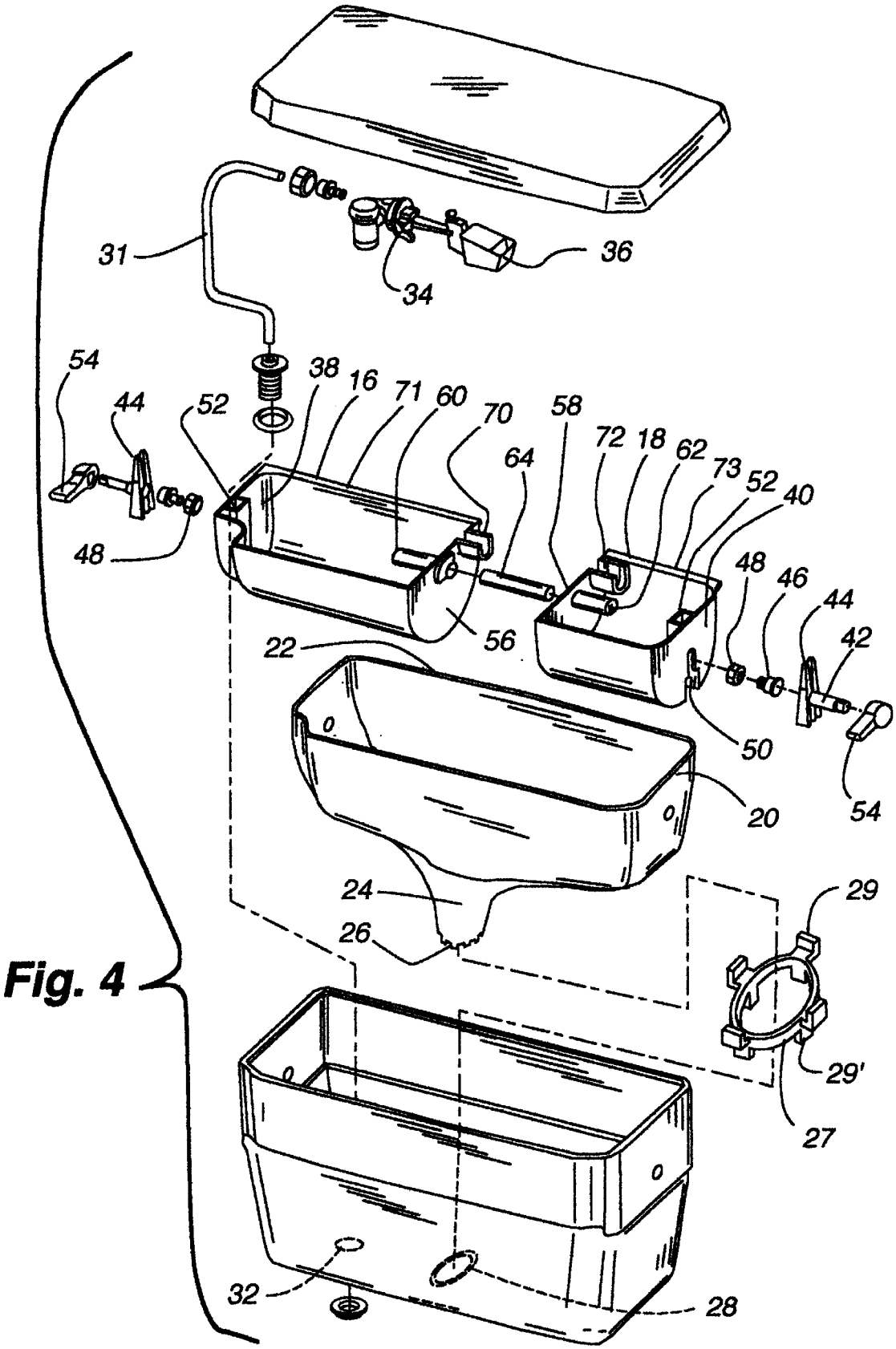
FIG. 4 is a more detailed exploded isometric view of one embodiment of the toilet tank of the present invention.
Figure 5:
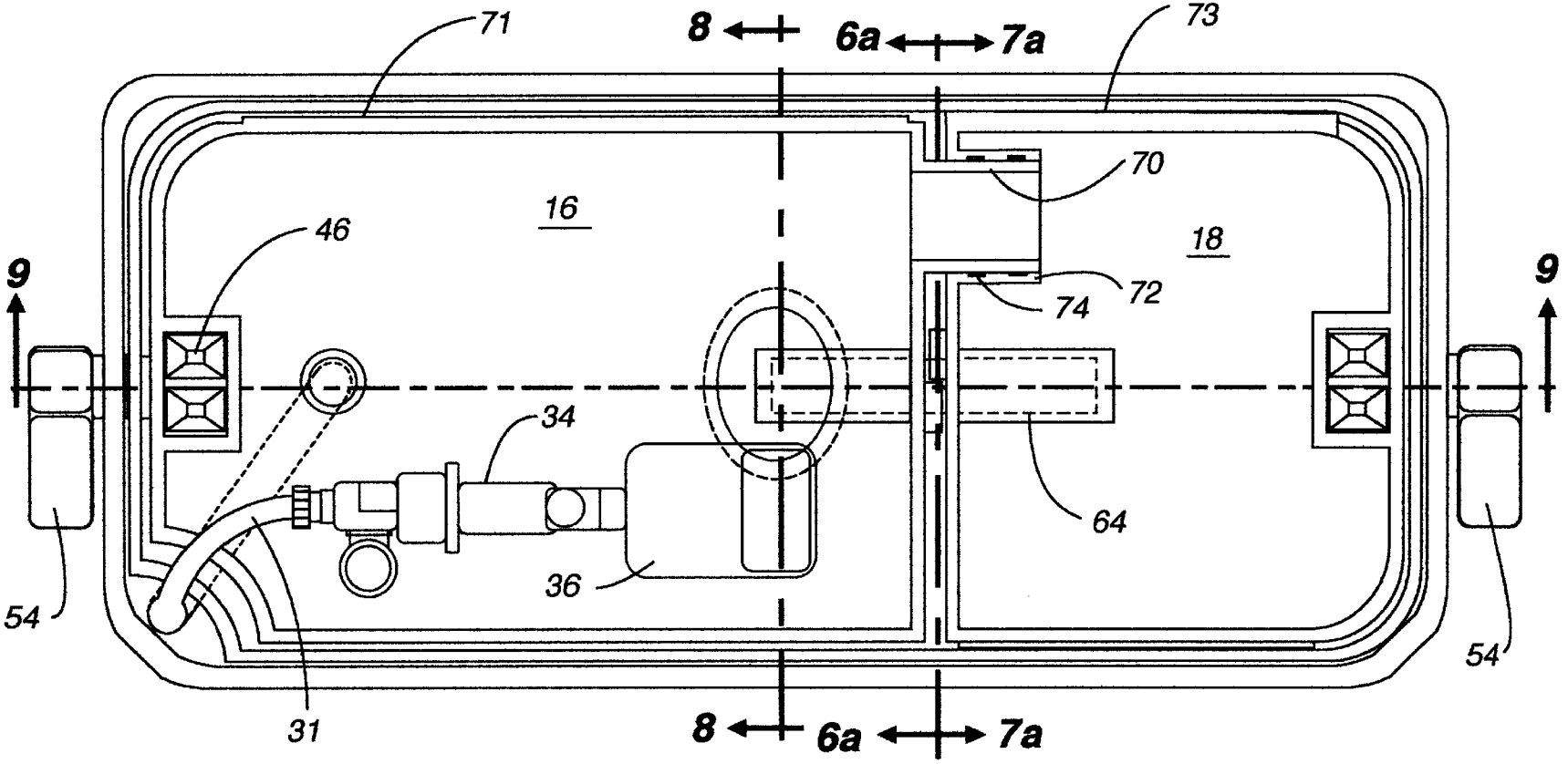
FIG. 5 is a plan view taken along line 5—5 of FIG. 3.

The dual flush capacity mechanism of one embodiment of the present invention may be utilized in a standard toilet tank having a water retention tank 12 and a conventional bowl 14. As best seen in FIG. 4 the dual flush capacity tank of the present invention includes a first water fill tank or bucket 16 and a second water fill tank or bucket 18. The first tank 16 has more water capacity than the second tank 18, as will be explained hereinafter. Preferably, but not essential, tank 16 will have a capacity of 1.0 gallon as this has been found a sufficient quantity of water to effectively evacuate a bowl 14 in which a user has merely urinated. Tank 18 preferably has a capacity of 0.6 gallons which, when combined with the 1.0 gallon retained in tank 16 would deliver 1.6 gallons per flush when both tanks are emptied, and this has been found to be a sufficient quantity of water to effectively evacuate bowl 14 in most instances even when the user has deposited a bowel movement in the toilet.

Both fill tanks 16 and 18 are pivotally mounted to tank 12 and pivotally mounted to each other so that the fill tanks 16 and 18 can pivot to discharge the water into the tank. The water is not directly discharged into the tank but is discharged into a plenum chamber 20 which narrows down as in a funnel from a wide open portion 22 which accommodates fill tanks 16 and 18 to a narrower funnel shaped portion 24 and an oval shaped discharge opening 26. A receiving adapter 27 is provided to fit into the discharge opening 28 of tank 12. Adapter 27, preferably of a plastic material, is provided with upwardly and outwardly positioned prongs 29 and downwardly positioned prongs 29'. The lower portion of plenum chamber 20 is received within prongs 29 in a snap fit fashion to securely locate and position the plenum chamber within tank 12 and prongs 29' fit within discharge opening 28 to secure the adapter. The end of funnel shaped portion 24 is saw-toothed with a plurality of cutouts 30, see FIGS. 7*a* and 7*b* as well, to provide a water flow through the bottom of tank 12 to fill the trap line so that odors from the out flow sewage line are contained. The depth of the cutouts 30 will increase or decrease with bowl design to assure minimum required water level above trap entry.

A water fill tube 31 is provided which is appropriately connected to an opening 32 in the bottom of tank 12 and tube 31 rises within tank 12. It terminates in a fill valve assembly 34 having a float control 36 which shuts off the in-flowing water when the water level in both fill tanks 16 and 18 causes float 36 to rise as is conventional in this art.

Reference is now made to FIGS. 4, 5, 6*a*, 6*b*, 7*a* and 7*b* for a description of the manner in which the two fill tanks 16 and 18 are cooperatively mounted so as to provide a dual flush capacity. The outer end portion 38 of fill tank 16 and the outer end portion 40 of fill tank 18 are each similarly pivotally mounted to the sides of tank 12. A pivotal mount includes a spindle 42 fixed to a clip 44 by an appropriate bushing 46 and nut 48. Clip 44 is received through an opening in each fill tank 16 and 18, in a cutout 50 after the opening to sit in a clip housing 52 within each fill tank 16 and 18. Spindle 42 is suitably journaled within the end wall of tank 12 to extend outwardly and receive an actuating handle 54. This is because each fill tank is pivotly mounted within tank 12 and with actuation of handle 54 will cause fill tank 16 and 18 to pivot downwardly from the position shown in FIGS. 6*a* and 7*a* to the position shown in FIGS. 6*b* and 7*b* to empty the contents of the water held in each fill tank into the plenum 20. The inner end 56 of fill tank 16 and the inner end 58 of fill tank 18 are also pivotly connected to each other. Each end 56 and 58 is provided with a through bore in which is disposed a bushing 60 and 62 which receives a spindle 64 therethrough.

Figure 6B:
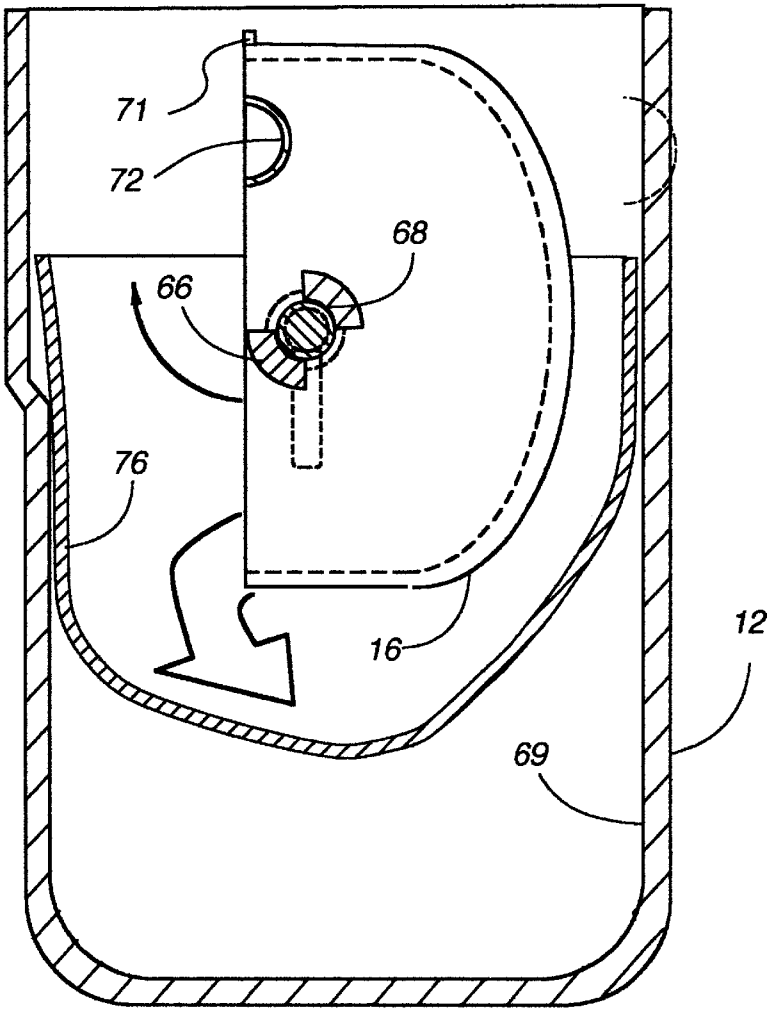
FIG. 6*b* is a view similar to FIG. 6*a* showing the mechanism of the present invention in a second position.
Figure 6A:
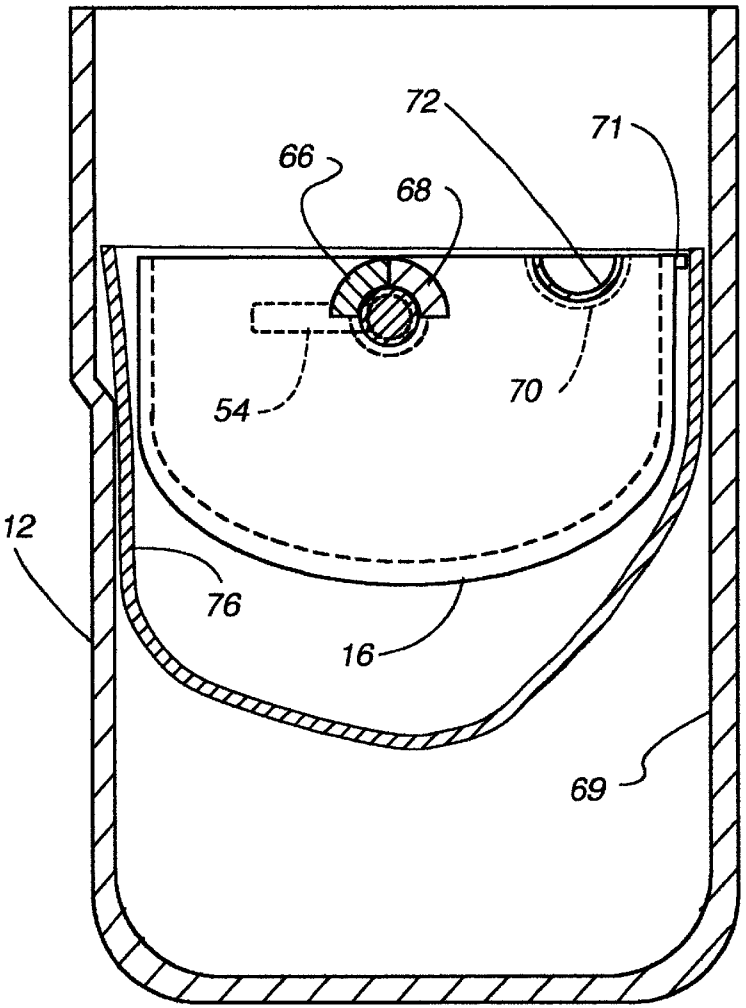
FIG. 6*a* is a sectional view taken along line 6*a*—6*a* of FIG. 5.

As best seen in FIGS. 6*a* and 6*b*, as well as in FIG. 4, the exterior surface of the inner end 56 of fill tank 16 and the exterior surface of inner end 58 of fill tank 18 are provided with cam surfaces which, by their position and cooperative relationship, determine which of the fill tanks rotate upon actuation of either the lever 54 connected to fill tank 16 or lever 54 connected to fill tank 18. The exterior surface of fill tank 16 includes a cam member 66 which is complimentary to and mates with a cam member 68 mounted on the exterior surface 58 of fill tank 18. Cam surfaces 66 and 68 are preferably in the shape of a half crescent which abutingly mate with each other.

Figure 7B:
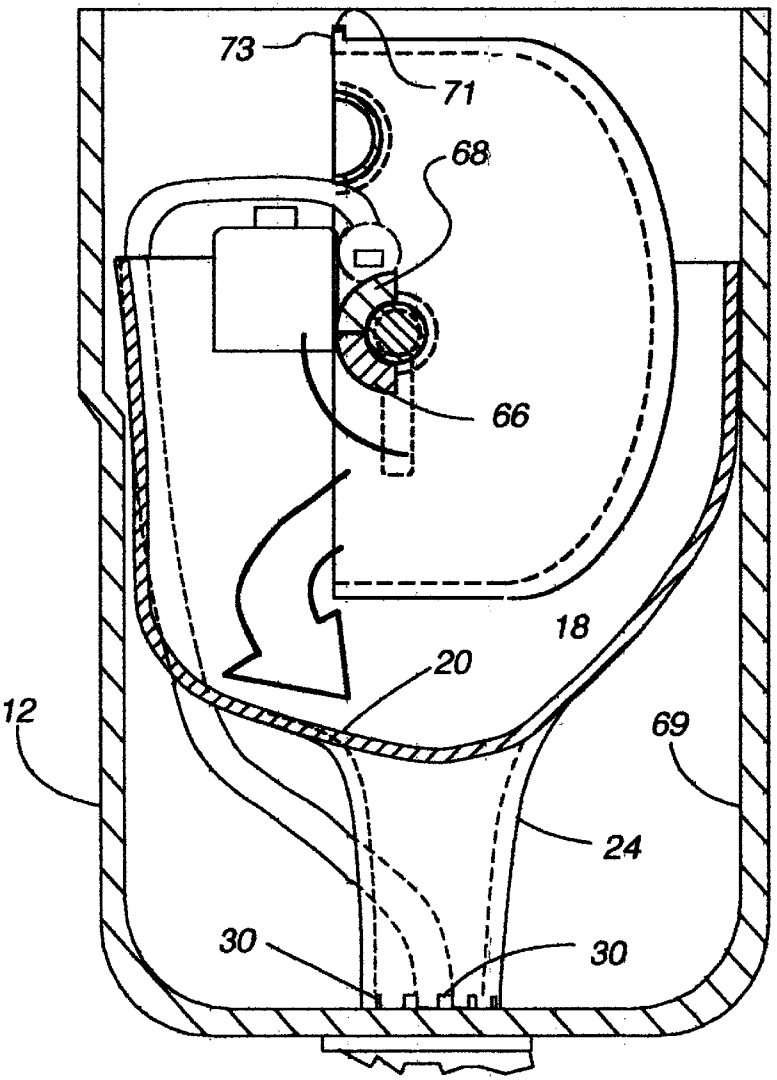
FIG. 7*b* is a sectional view similar to FIG. 7*a* showing the mechanism of the present invention in a second position.
Figure 7A:
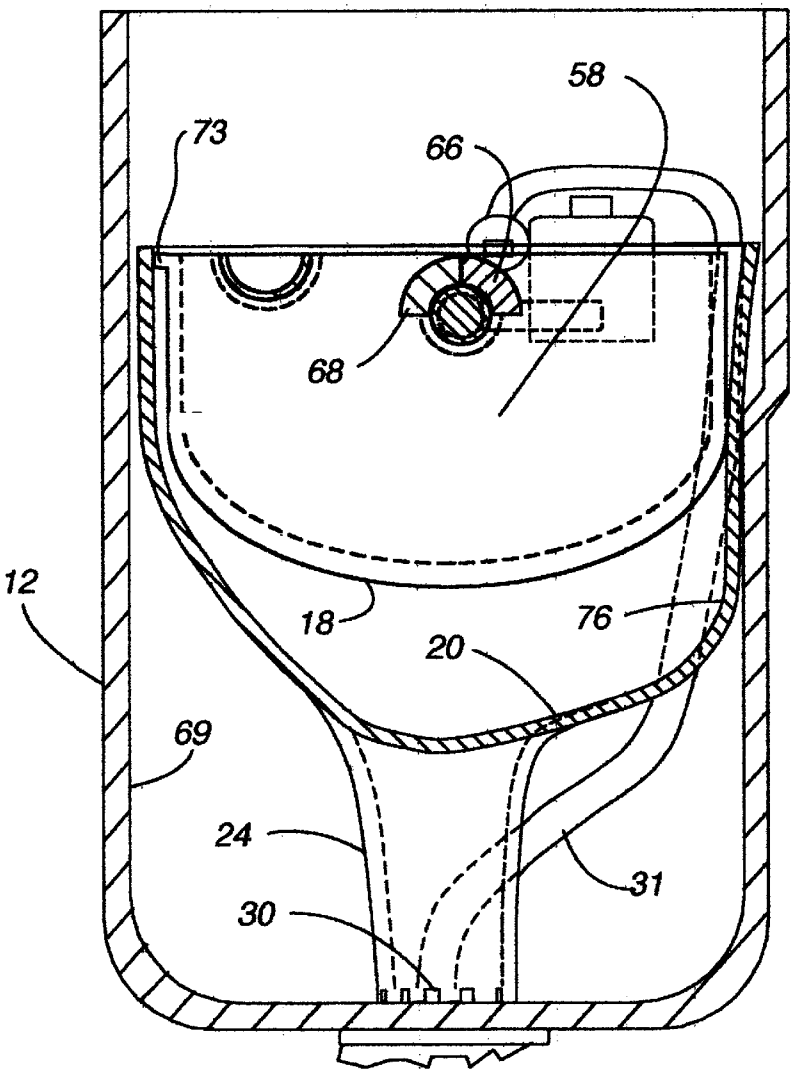
FIG. 7*a* is a sectional view taken along line 7*a*—7*a* of FIG. 5.
Figure 9:
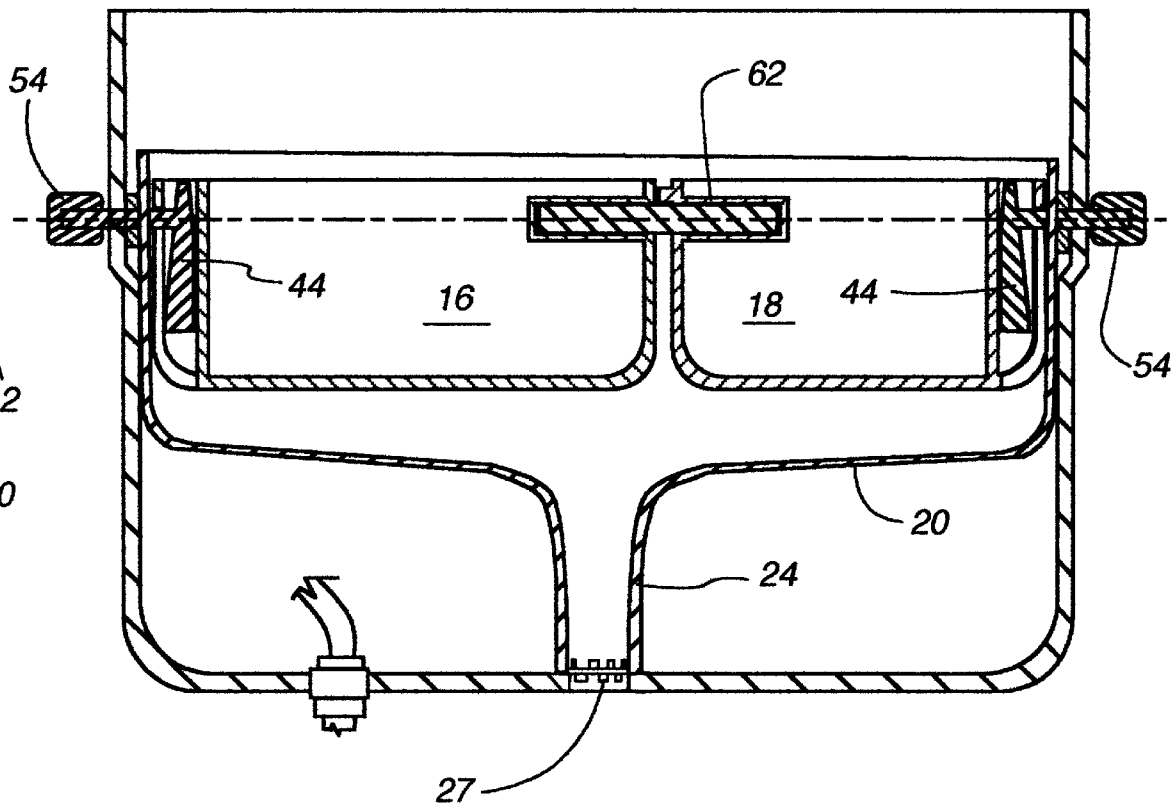
FIG. 9 is a sectional view taken along line 9—9 of FIG. 5.
Figure 8:
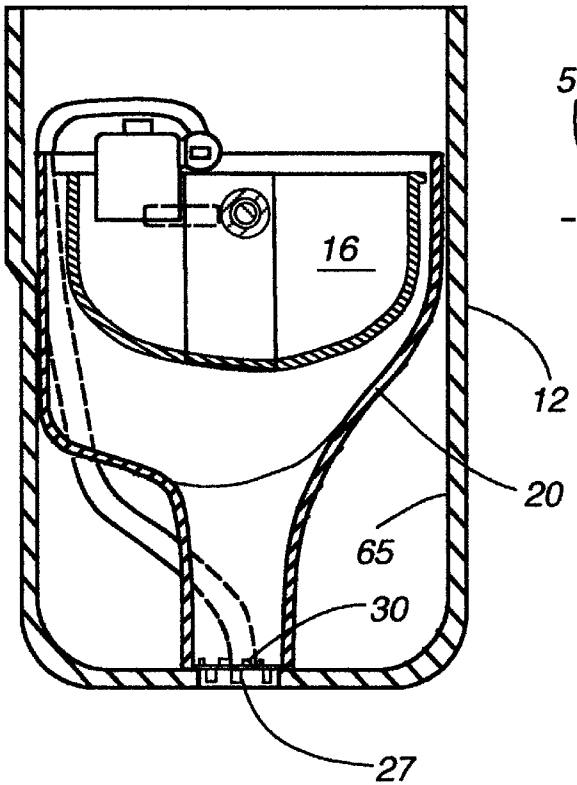
FIG. 8 is a sectional view taken along line 8—8 of FIG. 5.

With reference to FIGS. 6*a* and 6*b*, it is seen that when actuating handle 54 on the left side of fill tank 12 is depressed downwardly in the direction of the arrow, fill tank 16 will rotate to deposit the water contents into plenum 20. Thus tank 16 will rotate from the position shown in FIG. 6*a* to the position shown in FIG. 6*b* to deposit the water contents of fill tank 16 into the plenum leaving fill tank 18 in a stationary position and without emptying the contents of fill tank 18. When lever 54 on the right side of tank 12 is depressed, as shown in FIGS. 7*a* and 7*b*, cam surface 68 which is positioned in abutting relationship in face-to-face contact with cam surface 66 will cause fill tank 16 to rotate along with fill tank 18 to empty the contents of both fill tanks 16 and 18 into plenum 20. Thus, rotation of the left handle 54 will result in only fill tank 16 emptying its contents into plenum 20 while rotation of the right handle 54 will rotate fill tank 18 and, by the interaction of the cam surfaces matingly engaging both fill tanks, will also result in rotation of fill tank 16 so that the contents of both fill tanks 16 and 18 will enter into plenum 20 to eventually be discharged through the bowl 14 to complete flushing of the toilet. The trough cutout 70 extending from fill tank 16 also pushes downwardly against the mating trough 72 in fill tank 18 and assists with rotation of the fill tank when handle 54 on fill tank 18 is actuated.

To accommodate the selective rotation of fill tank 18 and the selective rotation of both fill tanks and 18 through the rotation of the selected handle 54, a slightly greater clearance is provided between the inside back wall 69 of tank 12 and the upper lip 71 of fill tank 16 than the clearance between back wall 69 and upper lip 73 of fill tank 18. This avoids any inadvertent movement of fill tank 16 when only fill tank 18 is moved. This is accomplished by providing an extending lip 71 on fill tank 16 and an extending lip 73 on fill tank 18 with lip 73 being slightly wider than lip 71.

After either fill tank 16 or both fill tanks 16 and 18 have been emptied on a toilet flush, water is allowed to enter through fill valve assembly 34, as is known in the art. Fill tank 16, where float control 36 is positioned is filled first and, subsequently, water is directed to fill tank 18 through a trough member 70 attached to the upper end of fill tank 16. Trough member 70 fits within a trough cutout 72 in the top of fill tank 18 and extends into fill tank 18. Thus water flows from fill tank 16 into fill tank 18. Appropriate rubber or plastic seals 74 are provided in trough cut out 72 to prevent leakage of water passing from fill tank 16 into fill tank 18. The seal is assisted by the pressure applied from the bottom surface of trough 70 acting against the trough 72 and its seals 74. The pressure comes from the weight of the water in fill tank 16 which is always pressing downwardly due to the fact that the shorter extending lip 71 does not contact the rear wall of plenum 20. The longer lip 73 extending from fill tank 18 does contact the rear wall of plenum 20.

The dual flush capacity toilet of the present invention works particularly well and is designed to be long lasting without the necessity of changing parts that wear out in time, such as flap valves or ball valves and the lift mechanisms associated with these valve structures. Accordingly, the invention utilizes a plenum chamber 20 which by its shape and design provides a number of beneficial aspects.

First, the plenum chamber in this invention enhances the ability to do without a flap or ball valve. Second, by its shape, it initially holds the dumped water up high which then funnels downwardly in a taper, thus providing a pressure head for the water dispensed into the plenum chamber which maximizes the water pressure entering the toilet bowl so that effective cleansing action of the bowl sides and complete evacuation of the bowl contents results.

The front wall 76 of plenum chamber 20 is at a much steeper angle to prevent splashing and sloshing of water as fill tanks 16 and 18 empty into the plenum chamber and to encourage more rapid transfer of water through the plenum.

Figure 10:
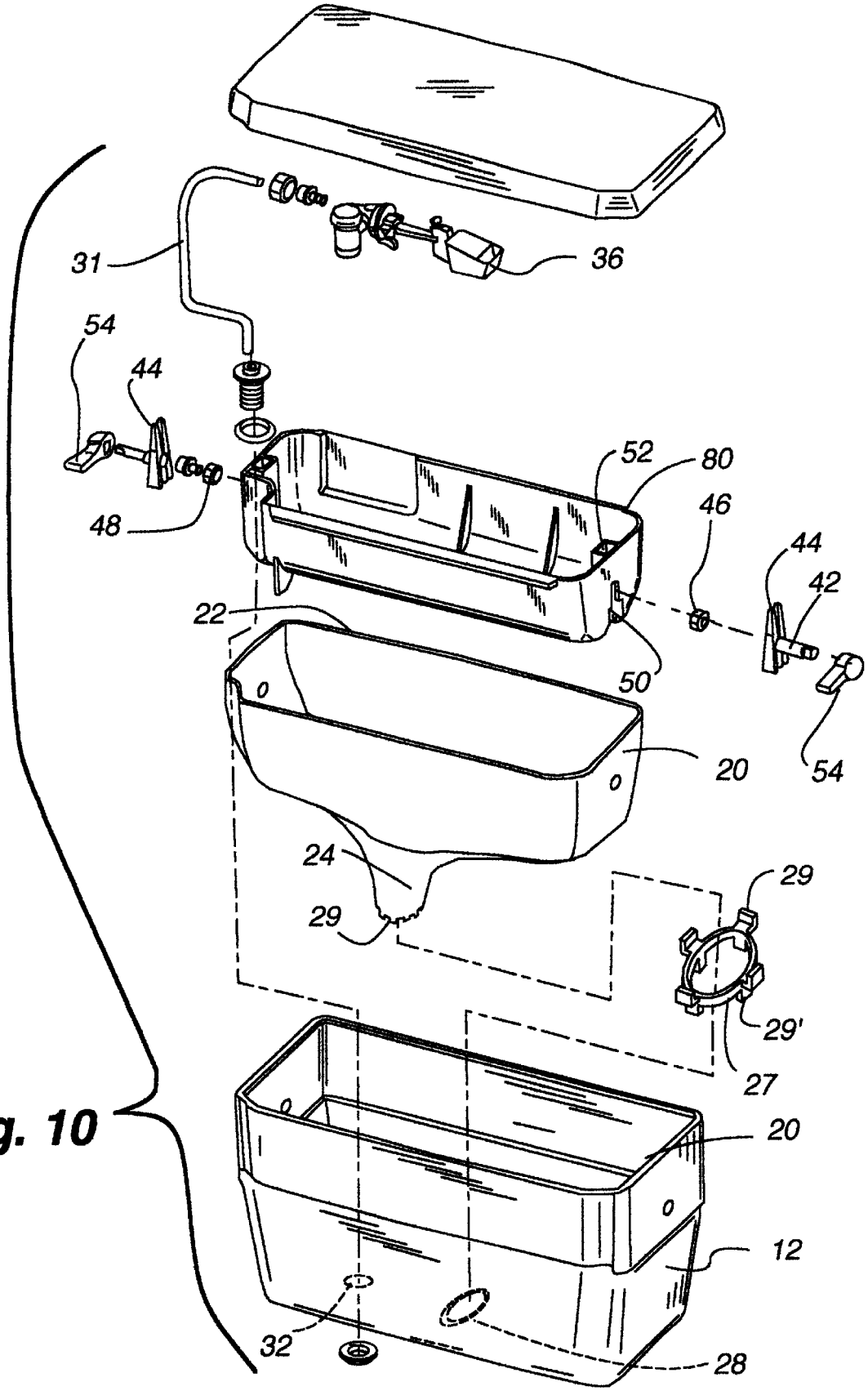
FIG. 10 is a view similar to FIG. 4 showing another embodiment of the present invention.

Reference is made to FIG. 10 for an alternative embodiment of the present invention where like parts as in the first embodiment are numbered the same. In this embodiment, the fill tank 80 may be a single tank or may comprise the two fill tanks 16 and 18 of the first embodiment. In this case the fill tanks 16 and 18 would be linked together.

In this embodiment, the dual flush capacity is obtained by limiting the movement of fill tank 80 when one of the actuating handles are rotated. Thus, for example, the right handle 54 is provided with a rotation stop 46' which limits rotation of right handle 54 and fill tank 80 to approximately 65% of its 90° rotation. Thus only 65% of the contents of fill tank 80 are deposited into plenum chamber 20 to accommodate disposal of only liquid waste.

On the other hand, the left handle 54 is allowed to rotate fully so that fill tank 80 rotates a sufficient extent to deposit all of the contents of fill tank 80 into plenum chamber 20 to dispose of solid waste.

What is claimed is:

1. A dual flush water conservation toilet comprising:

a tank operably connected to a toilet bowl to direct water from said tank to said bowl to flush the toilet;

a first fill tank pivotally mounted in said tank to hold a first quantity of water for flushing a toilet;

a second fill tank pivotally mounted in said tank to hold a second quantity of water for flushing a toilet;

an actuation lever operably associated with said first fill tank to pivot said first fill tank from a first position wherein said first quantity of water is retained in said first fill tank to a second position wherein said first quantity of water is deposited in said tank;

an actuation lever operably associated with said second fill tank to pivot said second fill tank from a first position wherein said second quantity of water is retained in said second fill tank to a second position wherein said second quantity of water is deposited in said tank;

said first and second fill tanks being pivotally connected with each other and linked so that when said first fill tank is pivoted from its said first position to its said second position said second fill tank remains in its said first position and wherein when said second fill tank is pivoted from its said first position to its said second position, said first fill tank is also pivoted from its first position to its second position so that the contents of both said first and second fill tanks are deposited in said tank.

2. A dual flush water conservation toilet according to claim 1 including a plenum chamber disposed in said tank to receive water from said first and second fill tanks as said fill tanks are pivoted and wherein said plenum chamber directs water from said fill tanks to said toilet bowl.

3. A dual flush water conservation toilet according to claim 2 wherein said plenum chamber is funnel shaped.

4. A dual flush water conservation toilet according to claim 3 wherein said funnel at the juncture of the tank includes cut outs to allow water to fill the trap line associated with said toilet to preclude odors from said trap line.

5. A dual flush water conservation toilet according to claim 3 wherein said funnel shape is angled downwardly to provide an increase in head pressure to maximize the flow properties of water exiting said plenum chamber into said toilet bowl.

6. A dual flush water conservation toilet according to claim 2 including an adapter ring to mount said plenum chamber within said tank.

7. A dual flush water conservation toilet according to claim 6 wherein said adapter ring includes upwardly projecting prongs to fit about the end of said plenum chamber to secure said plenum chamber to said adapter ring.

8. A dual flush water conservation toilet according to claim 5 wherein said plenum chamber has a steeper angle of inclination at its forward end where water from said first and second fill tanks is received to minimize sloshing and splashing of water.

9. A dual flush water conservation toilet according to claim 1 wherein said first and second fill tanks are each independently pivotably mounted within said tank.

10. A dual flush water conservation toilet according to claim 9 wherein each said first and second fill tanks include mating cam surfaces on the exterior of the side of said fill tanks which face each other, said cam surfaces interengaging such that rotation of one fill tank will not cause rotation of the other while rotation of the other fill tank will cause rotation of both fill tanks.

* * * * *